US008202829B2

(12) United States Patent
Devlin et al.

(10) Patent No.: US 8,202,829 B2
(45) Date of Patent: Jun. 19, 2012

(54) LUBRICATING COMPOSITION

(75) Inventors: Mark T. Devlin, Richmond, VA (US); Randall Eugene Baren, Glen Allen, VA (US); Tze-Chi Jao, Glen Allen, VA (US); Samuel H. Tersigni, Glen Allen, VA (US)

(73) Assignee: Afton Chemical Corporation, Richmond, VA (US)

( * ) Notice: Subject to any disclaimer, the term of this patent is extended or adjusted under 35 U.S.C. 154(b) by 893 days.

(21) Appl. No.: 10/981,372

(22) Filed: Nov. 4, 2004

(65) Prior Publication Data

US 2006/0094607 A1 May 4, 2006

(51) Int. Cl.
*C10M 101/02* (2006.01)
*C10M 133/12* (2006.01)

(52) U.S. Cl. ..... 508/563; 252/77

(58) Field of Classification Search ..... 508/563
See application file for complete search history.

(56) References Cited

U.S. PATENT DOCUMENTS

| | | | | |
|---|---|---|---|---|
| 3,915,871 | A | 10/1975 | Bryner et al. | |
| 4,627,929 | A | 12/1986 | Buysch et al. | |
| 5,073,278 | A | 12/1991 | Schumacher et al. | |
| 5,124,057 | A * | 6/1992 | Cohen | 508/257 |
| 2,129,657 | A | 8/1993 | Ostyn et al. | |
| 5,391,808 | A | 2/1995 | Babiarz et al. | |
| 2,189,387 | A | 5/1997 | Gatto et al. | |
| 5,650,381 | A | 7/1997 | Gatto et al. | |
| 5,840,672 | A | 11/1998 | Gatto | |
| 5,972,854 | A * | 10/1999 | Ichihashi et al. | 508/433 |
| 6,172,842 | B1 | 1/2001 | Satoh et al. | |
| 6,174,842 | B1 | 1/2001 | Gatto et al. | |
| 6,315,925 | B1 * | 11/2001 | Aebli et al. | 252/401 |
| 6,326,336 | B1 | 12/2001 | Gatto et al. | |
| 6,333,298 | B1 * | 12/2001 | Waddoups et al. | 508/373 |
| 2,403,540 | A1 | 5/2003 | Godici et al. | |
| 6,599,865 | B1 | 7/2003 | Esche, Jr. et al. | |
| 6,645,921 | B2 | 11/2003 | Gatto | |
| 6,726,855 | B1 * | 4/2004 | Migdal et al. | 252/401 |
| 6,872,693 | B2 * | 3/2005 | Cain | 508/185 |
| 6,890,890 | B2 * | 5/2005 | Gahagan | 508/192 |
| 7,282,134 | B2 * | 10/2007 | Abernathy et al. | 208/18 |
| 2002/0032129 | A1 * | 3/2002 | Tersigni et al. | 508/421 |
| 2005/0014656 | A1 * | 1/2005 | Sumiejski et al. | 508/192 |
| 2005/0261147 | A1 | 11/2005 | Rosenbaum et al. | |
| 2006/0073992 | A1 * | 4/2006 | Dong et al. | 508/422 |

FOREIGN PATENT DOCUMENTS

| | | |
|---|---|---|
| EP | 0286996 | 10/1988 |
| EP | 0387979 | 9/1990 |
| GB | 2384245 | 7/2003 |
| JP | 7286190 | 3/1994 |
| JP | 9217078 | 8/1997 |
| JP | 2003505533 | 2/2003 |
| WO | 0105917 | 1/2001 |
| WO | WO 02/064710 | 8/2002 |

OTHER PUBLICATIONS

Gatto et al., Journal of Synthetic Lubrication 2002, 19 (1), Abstract from pp. 3-18, (Apr. 2002).

I. Dzidic, H.A. Petersen, P.A. Wadsworth and H.V. Hart, "Townsend Discharge Nitric Oxide Chemical Ionization Gas Chromatography/Mass Spectrometry for Hydrocarbon Analysis of the Middle Distillates", *Analytical Chemistry*, 64, 2227, 1992.

C. A. Migdal, "Antioxidants", in Lubricant Additives : Chemistry and Applications, edited by Leslie R. Rudnick, Marcell Dekker, Inc., New York, 2003.

V.J. Gatto, M.A. Grina, H. T. Ryan, "The Influence of Chemical Structure on the Physical and Performance Properties of Hydrocracked Basestocks and Polyalphaolefins", Proceedings of the 12th International Colloquium on Tribology, Esslingen, Germany, 2000.

European Search Report, European Patent app. #05256851.6-2104/1657293,European Patent Office, Jul. 27, 2009.

A Collection of Lubrication Oil Term Explanations, Japan Lubrication Society, K.K. Asakura Shoten, Dec. 25, 1970, p. 67 (Partial English Translation).

Petroleum Manual, Presidential Office of Japan Petroleum K.K., 8th Edition, Sekiyu Shinjuusha, Jul. 31, 1977, p. 134 (Partial English Translation).

* cited by examiner

*Primary Examiner* — Ellen McAvoy
(74) *Attorney, Agent, or Firm* — Luedeka Neely Group, P.C.

(57) ABSTRACT

There is provided a lubricating composition having a major amount of a lubricating oil having less than about 40% by weight alkylcycloparaffins and a minor amount of at least one diarylamine, and processes for making and using thereof.

19 Claims, No Drawings

LUBRICATING COMPOSITION

FIELD OF THE INVENTION

The present disclosure relates to a lubricating composition comprising a major amount of a lubricating oil comprising less than about 40% by weight alkylcycloparaffins and a minor amount of at least one diarylamine. The lubricating composition disclosed herein includes fluids that may be suitable for use in an automatic transmission, a continuously variable transmission, a manual transmission, gear oils, and engine oils.

BACKGROUND OF THE INVENTION

Lubricating oils used in the internal combustion engines of automobiles or trucks are subjected to a demanding environment during use. Among other adverse effects, this environment can lead to oxidative degradation of the oil. This oxidation of the oil may be catalyzed by the presence of certain impurities in the oil, such as iron compounds. This oxidation also may be promoted by the elevated temperatures to which the oil is subjected during use. The oxidation of lubrication oils during use is usually controlled in part by the use of antioxidant additives, which may extend the useful life of the oil, for example by reducing or inhibiting unacceptable increases in the viscosity of the oil.

Automatic transmission fluids should be oxidatively stable to maintain their frictional properties as the fluids are aged. To test the oxidative stability of these fluids, automobile manufacturers, such as General Motors, require that fluids be tested in oxidation tests and cycling tests. In these tests, the total acid number (TAN) of the oil is measured throughout the test, and at the end of the test the TAN of the oil must be within specified limits.

Existing lubricants employing diarylamine and a sulfurized compound are taught in U.S. Pat. Nos. 5,840,672, 6,174,842, and 6,326,336.

U.S. Pat. No. 5,073,278 teaches a lubricant composition containing an aromatic amine and a sterically hindered amine. The aromatic amine can be a ring-substituted alkylphenothiazine or nitrogen substituted alkylated phenothiazine.

U.S. Pat. No. 6,645,921 discloses a process for producing organomolybdenum compositions that are highly useful as lubricant additives. The described process involves reacting a fatty oil with a diamine, followed by reaction with a molybdenum source.

U.S. Pat. No. 6,599,865 discloses a combination of (1) an alkylated diphenylamine, (2) a sulfurized olefin/fatty oil and/or an ashless dialkyldithiocarbamate, and (3) an alkylated phenothiazine, which is highly effective at controlling crankcase lubricant oxidation and deposit formation.

What is needed is a fluid composition that remains oxidatively stable and maintains its frictional properties over time. Moreover, the fluid should meet the limits specified by the automobile manufacturers in terms of the total acid number (TAN) during and at the end of the test.

SUMMARY OF THE INVENTION

According to various embodiments, there is provided a lubricating composition comprising a major amount of lubricating oil comprising less than about 40% by weight alkylcycloparaffins, and a minor amount of at least one diarylamine.

According to various embodiments, there is provided a method for improving the oxidative stability of a lubricating composition comprising including in the lubricating composition a lubricating oil comprising less than about 40% by weight alkylcycloparaffins and at least one diarylamine.

According to various embodiments, there is provided a transmission fluid comprising a major amount of a lubricating oil comprising less than about 40% by weight alkylcycloparaffins, and a minor amount of at least one diarylamine.

According to various embodiments, there is provided a method for improving oxidative stability comprising providing to an engine a fluid composition comprising a lubricating oil comprising less than about 40% by weight alkylcycloparaffins and at least one diarylamine.

According to various embodiments, there is provided a method for improving oxidative stability comprising providing to a transmission a fluid composition comprising a lubricating oil comprising less than about 40% by weight alkylcycloparaffins and at least one diarylamine.

According to various embodiments, there is provided an additive concentrate composition comprising a lubricating oil comprising less than about 40% by weight alkylcycloparaffins and at least one diarylamine.

According to various embodiments, there is provided a composition comprising a lubricating oil comprising less than about 40% by weight alkylcycloparaffins and at least one diarylamine, wherein the composition meets the standards for an oxidation test measuring a change in total acid number (TAN).

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

DESCRIPTION OF THE INVENTION

In accordance with the present disclosure, there is provided a lubricating composition comprising a major amount of a lubricating oil comprising less than about 40% by weight alkylcycloparaffins, and a minor amount of at least one diarylamine.

A "major amount" may be understood to mean greater than or equal to about 50%. A "minor amount" may be understood to mean less than about 50%.

The lubricating composition includes, but is not limited to, fluid compositions such as those suitable for use as an automatic transmission fluid (ATF), continuously variable transmission fluid, manual transmission fluid, a fluid used in dual clutch transmissions, gear oils, and engine oils.

While any conventional or non-conventional lubricating oil may be used in the present invention, the lubricating oil may be selected from, for example, paraffinic oils, naphthenic oils, aromatic oils, synthetic oils, derivatives thereof, and mixtures thereof. The paraffinic oils may comprise alkylcycloparaffins, such as monocycloparaffins and tetracycloparaffins. The reduction of alkylcycloparaffins and the addition of alkylaromatics may improve the oxidative stability of lubricant compositions.

Alkylcycloparaffins may be hydrocarbons that contain at least one cycloparaffinic ring (such as a C6 or C5 ring) with at least one attached alkyl group. Alkylcycloparaffins may include alkylcyclohexane, alkylcyclopentanes, alkyldicycloparaffins, and alkylpolycycloparaffins. In embodiments, alkylcyclohexanes and alklycyclopentanes may be used. Alkylcycloparaffins may be present in an amount of less than about 40% by weight, for example less than about 30% by weight based upon the total weight of the lubricating oil.

Alkylaromatics may be hydrocarbons which contain at least one aromatic ring with at least one attached alkyl group. Alkylaromatics may include alkylbenzenes, alkylnaphthalenes, alkyltetralines, and alkylpolynuclear aromatics. In embodiments, alkylbenzenes may be used.

The at least one diarylamine may be present in the lubricating composition in an amount sufficient to provide an antioxidant effect. According to certain embodiments, that amount may be, for example, at least about 0.40% by weight relative to the total weight of the lubricating composition. The concentration of the at least one diarylamine in the finished lubricating composition can vary depending upon the basestock used, customer requirements and applications, and the desired level of antioxidant protection required for the specific lubricating oil.

The at least one diarylamine may be a well-known antioxidant. There is no restriction on the type of the at least one diarylamine used in the invention. For example, the at least one diarylamine may have the general formula:

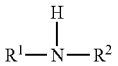

wherein $R^1$ and $R^2$ each independently may represent a substituted or unsubstituted aryl group having from about 6 to about 30 carbon atoms. Non-limiting examples of the substituents for the aryl group include alkyls having from about 1 to about 20 carbon atoms, hydroxy, carboxyl, and nitro, e.g., an alkaryl group having from about 7 to about 20 carbon atoms in the alkyl group. The aryl group may be, for example, substituted or unsubstituted phenyl or naphthyl, for example wherein one or both of the aryl groups may be substituted with an alkyl such as one having from about 4 to about 18 carbon atoms. In embodiments, both aryl groups may be substituted, e.g., alkyl substituted phenyl.

The at least one diarylamine used in accordance with the present disclosure can be of a structure other than that shown in the above formula which shows but one nitrogen atom in the molecule. Thus, the at least one diarylamine can be of a different structure provided that at least one nitrogen has about 2 aryl groups attached thereto, e.g., as in the case of various diamines having a secondary nitrogen atom as well as two aryls on one of the nitrogens. The at least one diarylamine used in this invention may have antioxidant properties in lubricating oils.

The at least one diarylamine should be oil soluble. Non-limiting examples of the at least one diarylamine that may be used in this disclosure include: diphenylamine, various alkylated diphenylamines, 3-hydroxydiphenylamine, N-phenyl1, 2-phenylenediamine, N-phenyl-1,4-phenylenediamine, monobutyldiphenylamine, butyldiphenylamine, dibutyldiphenylamine, monooctyldiphenylamine, octyldiphenylamine, dioctyldiphenylamine, monononyldiphenylamine, nonyldiphenylamine, dinonyldiphenylamine, heptyidiphenylamine, diheptyldiphenylamine, methylstyryldiphenylamine, phenyl-alpha-naphthylamine, phenyl-beta-naphthylamine, diheptyldiphenylamine, p-oriented styrenated diphenylamine, monotetradecyldiphenylamine, ditetradecyldiphenylamine, monooctyl phenyl-alpha-naphthylamine, monoheptyldiphenylamine, p-oriented styrenated diphenylamine, mixed butyl/octyl alkylated diphenylamines, mixed butyl/styryl alkylated diphenylamines, mixed nonyl/ethyl alkylated diphenylamines, mixed octyl/styryl alkylated diphenylamines, mixed ethyl/methylstyryl alkylated diphenylamines, octyl alkylated phenyl-alpha-naphthylamine, mixed alkylated phenyl-alpha-naphthylamines, and combinations of these at varying degrees of purity that are commonly used in the petroleum industry.

Non-limiting examples of commercial diarylamines include, for example, IRGANOX L06™, IRGANOX L57™, and IRGANOX L67™ from Ciba Specialty Chemicals; NAUGALUBE AMS™, NAUGALUBE 438™, NAUGALUBE 438R™, NAUGALUBE 438L™, NAUGALUBE 500™, NAUGALUBE 640™, NAUGALUBE 680™, and NAUGARD PANA™ from Crompton Corporation; GOODRITE 3123™, GOODRITE 3190X36™, GOODRITE 3127™, GOODRITE 3128™, GOODRITE 3185X1™, GOODRITE 3190X29™, GOODRITE 3190X40™, GOODRITE 3191™, and GOODRITE 3192™ from BF Goodrich Specialty Chemicals; HiTEC 569™ antioxidant, HiTEC 7190™, and HiTEC 4793™ antioxidant available from New-Market Services Corporation (formerly Ethyl Corporation); VANLUBE DND™, VANLUBE NA™, VANLUBE PNA™, VANLUBE SL™, VANLUBE SLHP™, VANLUBE SS™, VANLUBE 81™, VANLUBE 848™, and VANLUBE 849™ from R. T. Vanderbilt Company Inc.

It is believed, without being limited to any particular theory, that a lubricating composition comprising a major amount of a lubricating oil comprising less than about 40% by weight alkylcycloparaffins and a minor amount of at least one diarylamine may be oxidatively stable. One way to measure oxidation stability of a composition is for the composition to meet the standards for an oxidation test which measures the change in the TAN (total acid number). An example of an oxidation test is the MERCON® Aluminum Beaker Oxidation Test (ABOT), FMC BJ 10-4, revision 1, 2003, the disclosure of which is hereby incorporated by reference. Using this test a composition comprising a major amount of a lubricating oil comprising less than about 40% by weight alkylcycloparaffins and a minor amount of at least one diarylamine may have a change in the TAN of less than or equal to 5. The MERCON V® Aluminum Beaker Oxidation Test (ABOT) requires a composition to have a change in total acid number of less than about 3.5. As a further example, the G.M. DEXRON®-III, H Revision, ATF GMN10055, oxidation test, October 2003, the disclosure of which is hereby incorporated by reference, requires a composition to have a change in total acid number less than about 3.25, and the cycling test requires a composition to have a change in total acid number of less than about 2.0. The test names in the manual are: Q. Oxidation Test and R. Cycling Test. Q & R are the item letters in the manual. The other letters refer to other tests. These oxidation and cycling tests are described in detail in the appendix of the manual.

The lubricating composition may also comprise at least one additive in the appropriate proportions, thereby providing a multifunctional additive package. Examples of at least one additive which may be used include, but are not limited to, dispersants, detergents, antioxidants, carrier fluids, metal deactivators, dyes, markers, corrosion inhibitors, biocides, antistatic additives, drag-reducing agents, demulsifiers, dehazers, anti-icing additives, anti-knock additives, anti-valve-seat recession additives, lubricity additives, combustion improvers, cold flow improvers, friction modifiers, antiwear agents, antifoam agents, viscosity index improvers, antirust additives, seal swell agents, metal deactivators, and air expulsion additives.

In selecting at least one additive, one should ensure that the selected additive(s) is/are soluble or stably dispersible in the additive package and finished composition, are compatible with the other components of the composition, and do not interfere significantly with the performance properties of the composition, such as improved oxidative stability, needed or desired, as applicable, in the overall finished composition.

For the sake of convenience, the at least one additive may be provided as a concentrate for dilution. Such a concentrate forms part of the present invention and typically comprises from about 99 to about 1% by weight additive and from about 1 to about 99% by weight of solvent or diluent for the additive, which solvent or diluent may be miscible and/or capable of dissolving in the composition in which the concentrate may be used. The solvent or diluent may, of course, be the lubricant oil itself.

In general, the at least one additive may be employed in minor amounts sufficient to improve the performance characteristics and properties of the base fluid. The amounts will thus vary in accordance with such factors as the viscosity characteristics of the base fluid employed, the viscosity characteristics desired in the finished fluid, the service conditions for which the finished fluid is intended, and the performance characteristics desired in the finished fluid.

It will be appreciated that the individual components employed can be separately blended into the base fluid or can be blended therein in various subcombinations, if desired. Ordinarily, the particular sequence of such blending steps may not be crucial. Moreover, such components can be blended in the form of separate solutions in a diluent. According to various embodiments, however, the additive components may be blended in the form of a concentrate, as this simplifies the blending operations, reduces the likelihood of blending errors, and takes advantage of the compatibility and solubility characteristics afforded by the overall concentrate.

According to various embodiments, the transmission fluid composition may be used in the transmission of a vehicle, such as in a torque converter.

Moreover, the lubricating composition may be used in a variety of oils to lubricate any machinery, such as in gear oils and engine oils.

EXAMPLES

In the oxidation test, a fluid was added to an automatic transmission which was driven by an electric motor for 450 hours with air being bubbled through the fluid. At the end of the 450 hr test, the TAN of the used oil was measured and compared to the TAN of the fresh oil.

In the cycling test a fluid was added to an automatic transmission which was driven by an engine. The transmission was cycled from first to fourth gear 32,000 times. At the end of the 32,000 cycles the TAN of the used oil was measured and compared to the TAN of the fresh oil.

A GC-MS technique was used to determine the composition of the base oils used to formulate automatic transmission fluids. Using this technique, the percent of mono- and tetracycloparaffins in the fluids was determined. See I. Dzidic, H. A. Petersen, P. A. Wadsworth and H. V. Hart, "Townsend Discharge Nitric Oxide Chemical Ionization Gas Chromatography/Mass Spectrometry for Hydrocarbon Analysis of the Middle Distillates", *Analytical Chemistry,* 64, 2227, 1992, the disclosure of which is hereby incorporated by reference.

It is known that diarylamines can improve the oxidative stability of oils and that diarylamines may be more effective in Group II than Group I oils. C. A. Migdal, "Antioxidants", in Lubricant Additives: Chemistry and Applications, edited by Leslie R. Rudnick, Marcell Dekker, Inc., New York, 2003, the disclosure of which is hereby incorporated by reference. Furthermore, the oxidative stability of oil may improve if the concentration of the double ring and multiring condensed cycloparaffins in an oil are reduced. V. J. Gatto, M. A. Grina, H. T. Ryan, "The Influence of Chemical Structure on the Physical and Performance Properties of Hydrocracked Basestocks and Polyalphaolefins", Proceedings of the 12th International Colloquium on Tribology, Esslingen, Germany, 2000, the disclosure of which is hereby incorporated by reference.

However, the examples in the following table show that the concentration of monocycloparaffins in the base oil may be a factor relating to oxidation control in transmission tests and that a range of concentration of monocycloparaffins, tetracycloparaffins and diarylamine, resulting in many possible formulations, may meet the oxidative stability required in transmission tests.

In the following Table, Examples A and B were formulated with a Group I base oil and Examples C-H were formulated with a Group II base oil.

| Example | DPA wt. % | % monocycloparaffin in base oil | % tetracycloparaffin in base oil | dTAN GMOT <3.25 | dTAN GM cycling test <2.00 |
|---|---|---|---|---|---|
| A | 0.50 | 31.3 | 2.7 | 2.95 | 3.50 |
| B | 0.50 | 31.1 | 2.6 | 4.43 | 3.26 |
| C | 0.50 | 28.4 | 1.3 | 2.15 | 1.03 |
| D | 0.50 | 28.7 | 1.5 | 1.94 | 0.87 |
| E | 0.50 | 30.0 | 1.1 | 1.92 | 0.91 |
| F | 0.50 | 27.1 | 2.8 | 3.51 | 1.17 |
| G | 0.40 | 23.4 | 0.8 | 1.02 | 1.35 |
| H | 0.25 | 29.9 | 1.7 | 2.72 | 3.04 |

Comparative examples A and B show the GMOT and GM cycling dTAN results for two oils containing about 0.5 wt % DPA with base oil combinations containing more than about 30 wt. % monocycloparaffins and more than about 2.5 wt. % tetracycloparaffins. Both oils failed the dTAN requirement for the GM cycling test and comparative example B fails the dTAN requirements for the GMOT. Inventive examples C, D, E, and G show that if the wt. % monocycloparaffins in the base oil combination is less than about 30 and if the wt. % tetracycloparaffins is less than about 2.0 and are combined with oils containing at least about 0.40 wt. % DPA then passing dTAN results are achieved in both the GMOT and GM cycling test. Comparative example F shows that if an ATF containing a base oil combination containing less than about 30 wt. % monocycloparaffins and more than about 2.0 wt. % tetracycloparaffins is formulated with about 0.50 wt. % DPA then the oil has higher dTAN values in the GMOT test. Finally, comparative example H shows that if an ATF containing a base oil combination containing less than about 30 wt. % monocycloparaffins and less than about 2.0 wt. % tetracycloparaffins is formulated with about 0.25 wt. % DPA then the oil has higher dTAN values in the GMOT and GM cycling tests than the invention examples and fails the dTAN requirement for the GM cycling test. Comparative examples F and H also show that not all Group II base oils can meet the dTAN requirement for both the GMOT and GM cycling test and that several possible combinations of varying concentrations of monocycloparaffins, tetracycloparaffins and diarylamine antioxidant may be required.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A lubricating composition comprising a major amount of non-synthetic lubricating oil comprising monocycloparaffins in an amount less than about 30% by weight and tetracycloparaffins in an amount of at least 0.8% and less than about 2.0% by weight, relative to the total weight of the composition; and at least about 0.40% by weight of at least one diarylamine, relative to the total weight of the composition, wherein the lubricating composition does not comprise synthetic oils, wherein the at least one diarylamine is selected from the group consisting of diphenylamine, 3-hydroxydiphenylamine, N-phenyl-1,2-phenylenediamine, N-phenyl-1,4-phenylenediamine, monobutyldiphenylamine, butyldiphenylamine, dibutyldiphenylamine, octyldiphenylamine, dioctyldiphenylamine, nonyldiphenylamine, dinonyldiphenylamine, heptyldiphenylamine, diheptyldiphenylamine, methylstyryldiphenylamine, phenyl-beta-naphthylamine, diheptyldiphenylamine, p-oriented styrenated diphenylamine, monotetradecyldiphenylamine, ditetradecyldiphenylamine, monooctyl phenyl-alpha-naphthylamine, monoheptyldiphenylamine, p-oriented styrenated diphenylamine, mixed butyl/octyl alkylated diphenylamines, mixed butyl/styryl alkylated diphenylamines, mixed nonyl/ethyl alkylated diphenylamines, mixed octyl/styryl alkylated diphenylamines, mixed ethyl/methylstyryl alkylated diphenylamines, octyl alkylated phenyl-alpha-naphthylamine, mixed alkylated phenyl-alpha-naphthylamines, and combinations thereof.

2. The lubricating composition according to claim 1, wherein the lubricating oil is a paraffinic oil.

3. A method for improving the oxidative stability of a lubricating composition comprising including in the lubricating composition a non-synthetic lubricating oil comprising monocycloparaffins in an amount less than about 30% by weight and tetracycloparaffins in an amount of at least 0.8% and less than about 2.0% by weight, relative to the total weight of the composition; and at least about 0.40% by weight of at least one diarylamine, relative to the total weight of the composition, wherein the lubricating composition does not comprise synthetic oils, wherein the at least one diarylamine is selected from the group consisting of diphenylamine, 3-hydroxydiphenylamine, N-phenyl-1,2-phenylenediamine, N-phenyl-1,4-phenylenediamine, monobutyldiphenylamine, butyldiphenylamine, dibutyldiphenylamine, octyldiphenylamine, dioctyldiphenylamine, nonyldiphenylamine, dinonyldiphenylamine, heptyldiphenylamine, diheptyldiphenylamine, methylstyryldiphenylamine, phenyl-beta-naphthylamine, diheptyldiphenylamine, p-oriented styrenated diphenylamine, monotetradecyldiphenylamine, ditetradecyldiphenylamine, monooctyl phenyl-alpha-naphthylamine, monoheptyldiphenylamine, p-oriented styrenated diphenylamine, mixed butyl/octyl alkylated diphenylamines, mixed butyl/styryl alkylated diphenylamines, mixed nonyl/ethyl alkylated diphenylamines, mixed octyl/styryl alkylated diphenylamines, mixed ethyl/methylstyryl alkylated diphenylamines, octyl alkylated phenyl-alpha-naphthylamine, mixed alkylated phenyl-alpha-naphthylamines, and combinations thereof.

4. A method for lubricating an engine, comprising lubricating said engine with the lubricating composition of claim 1.

5. A transmission fluid comprising a major amount of a non-synthetic lubricating oil comprising monocycloparaffins in an amount less than about 30% by weight and tetracycloparaffins in an amount of at least 0.8% and less than about 2.0% by weight, relative to the total weight of the composition; and at least about 0.40% by weight of at least one diarylamine, relative to the total weight of the composition, wherein the lubricating composition does not comprise synthetic oils, wherein the at least one diarylamine is selected from the group consisting of diphenylamine, 3-hydroxydiphenylamine, N-phenyl-1,2-phenylenediamine, N-phenyl-1,4-phenylenediamine, monobutyldiphenylamine, butyldiphenylamine, dibutyldiphenylamine, octyldiphenylamine, dioctyldiphenylamine, nonyldiphenylamine, dinonyldiphenylamine, heptyldiphenylamine, diheptyldiphenylamine, methylstyryldiphenylamine, phenyl-beta-naphthylamine, diheptyldiphenylamine, p-oriented styrenated diphenylamine, monotetradecyldiphenylamine, ditetradecyldiphenylamine, monooctyl phenyl-alpha-naphthylamine, monoheptyldiphenylamine, p-oriented styrenated diphenylamine, mixed butyl/octyl alkylated diphenylamines, mixed butyl/styryl alkylated diphenylamines, mixed nonyl/ethyl alkylated diphenylamines, mixed octyl/styryl alkylated diphenylamines, mixed ethyl/methylstyryl alkylated diphenylamines, octyl alkylated phenyl-alpha-naphthylamine, mixed alkylated phenyl-alpha-naphthylamines, and combinations thereof.

6. The fluid composition according to claim 5, wherein the lubricating oil is a paraffinic oil.

7. The fluid composition according to claim 5, wherein the fluid composition is selected from the group consisting of automatic transmission fluids, continuously variable transmission fluids, manual transmission fluids, and fluids used in dual clutch transmissions.

8. The fluid composition according to claim 5, further comprising at least one additive selected from the group consisting of dispersants, detergents, antioxidants, carrier fluids, metal deactivators, dyes, markers, corrosion inhibitors, biocides, antistatic additives, drag-reducing agents, demulsifiers, dehazers, anti-icing additives, anti-knock additives, anti-valve-seat recession additives, lubricity additives, combustion improvers, cold flow improvers, friction modifiers, antiwear agents, antifoam agents, viscosity index improvers, antirust additives, seal swell agents, metal deactivators, and air expulsion additives.

9. A vehicle comprising a transmission, the transmission including the transmission fluid composition according to claim 5.

10. A method for improving oxidative stability comprising providing to an engine a fluid composition comprising a non-synthetic lubricating oil comprising monocycloparaffins in an amount less than about 30% by weight and tetracycloparaffins in an amount of at least 0.8% and less than about 2.0% by weight, relative to the total weight of the composition; and at least about 0.40% by weight of at least one diarylamine, relative to the total weight of the composition, wherein the lubricating composition does not comprise synthetic oils, wherein the at least one diarylamine is selected from the group consisting of diphenylamine, 3-hydroxydiphenylamine, N-phenyl-1,2-phenylenediamine, N-phenyl-1,4-phenylenediamine, monobutyldiphenylamine, butyldiphenylamine, dibutyldiphenylamine, octyldiphenylamine, dioctyldiphenylamine, nonyldiphenylamine, dinonyldiphenylamine, heptyldiphenylamine, diheptyldiphenylamine, methylstyryldiphenylamine, phenyl-beta-naphthylamine, diheptyldiphenylamine, p-oriented styrenated diphenylamine, monotetradecyldiphenylamine, ditetradecyldiphenylamine, monooctyl phenyl-alpha-naphthylamine, monoheptyldiphenylamine, p-oriented styrenated diphenylamine, mixed butyl/octyl alkylated diphenylamines, mixed butyl/styryl alkylated diphenylamines, mixed nonyl/ethyl alkylated diphenylamines, mixed octyl/styryl alkylated diphenylamines, mixed ethyl/methylstyryl alkylated diphenylamines, octyl alkylated phenyl-alpha-naphthylamine, mixed alkylated phenyl-alpha-naphthylamines, and combinations thereof.

11. A method for improving oxidative stability comprising providing to a transmission a fluid composition comprising a non-synthetic lubricating oil comprising monocycloparaffins in an amount less than about 30% by weight and tetracycloparaffins in an amount of at least 0.8% and less than about 2.0% by weight, relative to the total weight of the composition; and at least about 0.40% by weight of at least one diarylamine, relative to the total weight of the composition, wherein the lubricating composition does not comprise synthetic oils, wherein the at least one diarylamine is selected from the group consisting of diphenylamine, 3-hydroxydiphenylamine, N-phenyl-1,2-phenylenediamine, N-phenyl-1,4-phenylenediamine, monobutyldiphenylamine, butyldiphenylamine, dibutyldiphenylamine, octyldiphenylamine, dioctyldiphenylamine, nonyldiphenylamine, dinonyldiphenylamine, heptyldiphenylamine, diheptyldiphenylamine, methylstyryldiphenylamine, phenyl-beta-naphthylamine, diheptyldiphenylamine, p-oriented styrenated diphenylamine, monotetradecyldiphenylamine, ditetradecyldiphenylamine, monooctyl phenyl-alpha-naphthylamine, monoheptyldiphenylamine, p-oriented styrenated diphenylamine, mixed butyl/octyl alkylated diphenylamines, mixed butyl/styryl alkylated diphenylamines, mixed nonyl/ethyl alkylated diphenylamines, mixed octyl/styryl alkylated diphenylamines, mixed ethyl/methylstyryl alkylated diphenylamines, octyl alkylated phenyl-alpha-naphthylamine, mixed alkylated phenyl-alpha-naphthylamines, and combinations thereof.

12. An additive concentrate composition comprising a non-synthetic lubricating oil comprising monocycloparaffins in an amount less than about 30% by weight and tetracycloparaffins in an amount of at least 0.8% and less than about 2.0% by weight, relative to the total weight of the composition; and at least about 0.40% by weight of at least one diarylamine, relative to the total weight of the composition, wherein the lubricating composition does not comprise synthetic oils, wherein the at least one diarylamine is selected from the group consisting of diphenylamine, 3-hydroxydiphenylamine, N-phenyl-1,2-phenylenediamine, N-phenyl-1,4-phenylenediamine, monobutyldiphenylamine, butyldiphenylamine, dibutyldiphenylamine, octyldiphenylamine, dioctyldiphenylamine, nonyldiphenylamine, dinonyldiphenylamine, heptyldiphenylamine, diheptyldiphenylamine, methylstyryldiphenylamine, phenyl-beta-naphthylamine, diheptyldiphenylamine, p-oriented styrenated diphenylamine, monotetradecyldiphenylamine, ditetradecyldiphenylamine, monooctyl phenyl-alpha-naphthylamine, monoheptyldiphenylamine, p-oriented styrenated diphenylamine, mixed butyl/octyl alkylated diphenylamines, mixed butyl/styryl alkylated diphenylamines, mixed nonyl/ethyl alkylated diphenylamines, mixed octyl/styryl alkylated diphenylamines, mixed ethyl/methylstyryl alkylated diphenylamines, octyl alkylated phenyl-alpha-naphthylamine, mixed alkylated phenyl-alpha-naphthylamines, and combinations thereof.

13. The additive concentrate composition according to claim 12, further comprising at least one additive selected from the group consisting of dispersants, detergents, antioxidants, carrier fluids, metal deactivators, dyes, markers, corrosion inhibitors, biocides, antistatic additives, drag-reducing agents, demulsifiers, dehazers, anti-icing additives, anti-knock additives, anti-valve-seat recession additives, lubricity additives, combustion improvers, cold flow improvers, friction modifiers, antiwear agents, antifoam agents, viscosity index improvers, antirust additives, seal swell agents, metal deactivators, and air expulsion additives.

14. A composition comprising a non-synthetic lubricating oil comprising monocycloparaffins in an amount less than about 30% by weight and tetracycloparaffins in an amount of at least 0.8% and less than about 2.0% by weight, relative to the total weight of the composition; and at least about 0.40% by weight of at least one diarylamine, relative to the total weight of the composition, wherein the composition meets the standards for an oxidation test measuring a change in total acid number, and wherein the lubricating composition does not comprise synthetic oils, wherein the at least one diarylamine is selected from the group consisting of diphenylamine, 3-hydroxydiphenylamine, N-phenyl-1,2-phenylenediamine, N-phenyl-1,4-phenylenediamine, monobutyldiphenylamine, butyldiphenylamine, dibutyldiphenylamine, octyldiphenylamine, dioctyldiphenylamine, nonyldiphenylamine, dinonyldiphenylamine, heptyldiphenylamine, diheptyldiphenylamine, methylstyryldiphenylamine, phenyl-beta-naphthylamine, diheptyldiphenylamine, p-oriented styrenated diphenylamine, monotetradecyldiphenylamine, ditetradecyldiphenylamine, monooctyl phenyl-alpha-naphthylamine, monoheptyldiphenylamine, p-oriented styrenated diphenylamine, mixed butyl/octyl alkylated diphenylamines, mixed butyl/styryl alkylated diphenylamines, mixed nonyl/ethyl alkylated diphenylamines, mixed octyl/styryl alkylated diphenylamines, mixed ethyl/methylstyryl alkylated diphenylamines, octyl alkylated phenyl-alpha-naphthylamine, mixed alkylated phenyl-alpha-naphthylamines, and combinations thereof.

15. The composition according to claim 14, wherein the change in total acid number is less than or equal to about 5.

16. The composition according to claim 14, wherein the change in total acid number is less than about 3.25.

17. The composition according to claim 14, wherein the change in total acid number is less than about 2.0.

18. A vehicle comprising the composition according to claim 14.

19. An automatic transmission comprising the composition according to claim 14.

* * * * *